United States Patent [19]

Landry et al.

[11] Patent Number: 4,679,623

[45] Date of Patent: Jul. 14, 1987

[54] TRIPLE PASS CERAMIC CROSS-FLOW HEAT RECUPERATOR

[75] Inventors: Richard E. Landry; Joel G. Reed, both of Towanda, Pa.

[73] Assignee: GTE Products Corporation, Stamford, Conn.

[21] Appl. No.: 895,531

[22] Filed: Aug. 11, 1986

Related U.S. Application Data

[60] Continuation of Ser. No. 705,256, Feb. 25, 1985, abandoned, which is a division of Ser. No. 536,030, Sep. 26, 1983.

[51] Int. Cl.[4] ..... F28F 3/00

[52] U.S. Cl. ..... 165/166; 165/145

[58] Field of Search ..... 165/145, 166

[56] References Cited

U.S. PATENT DOCUMENTS

| | | | |
|---|---|---|---|
| 4,130,160 | 12/1978 | Dziedzic | 165/166 |
| 4,362,209 | 12/1982 | Cleveland | 165/166 |
| 4,466,482 | 8/1984 | Dorazio et al. | 165/145 |

*Primary Examiner*—Allen M. Ostrager

*Attorney, Agent, or Firm*—James Theodosopoulos

[57] ABSTRACT

A heat recuperator having a triple pass cross-flow ceramic core comprising ribbed layers bonded together has divider ribs thicker than other supporting ribs in order to provide greater seal area to adjoining layer.

5 Claims, 6 Drawing Figures

TRIPLE PASS CERAMIC CROSS-FLOW HEAT RECUPERATOR

This application is a continuation of application Ser. No. 705,256, filed 2/25/85 now abandoned which is a division of Ser. No. 536,030, filed 9/26/83 now pending.

This invention concerns ceramic cross-flow heat recuperators. Such recuperator comprise a ceramic heat-exchanger core within a suitable housing and are shown in U.S. Pat. Nos. 3,948,317, 4,083,400, 4,130,160, 4,262,740, 4,279,297, 4,300,627 and 4,362,209. In such cores, a gas to be heated flows through ribbed layers in the core, and a hot gas flows orthogonally thereto through similar ribbed layers alternated therewith. The flow is actually through channels between ribs. This invention is particularly concerned with a triple pass core, that is to say, a core where one of the gases is thrice passed through the core, in the manner shown in UK patent appliction 2,110,361A, corresponding to U.S. application Ser. No. 325,415, filed Nov. 27, 1981.

We have found that a problem can occur in prior art cores, such as those shown in U.S. Pat. Nos. 4,083,400, 4,130,160, 4,300,627, 4,362,209 and 4,379,109, when used in triple pass recuperators. In such cores, the edges may comprise a solid wide rib, as in FIG. 7 of U.S. Pat. No. 4,362,209 or a plurality of closely spaced ribs, as in FIG. 6 of U.S. Pat No. 4,362,209 or FIG. 3 of U.S. Pat. No. 4,300,627, but the supporting ribs between edges are quite thin and are usually uniformly spaced, so that all the channels are usually about the same width. The problem is that the ribs are too thin to ensure a reliable seal to adjoining layers throughout the life of the core, the seal usually being made by a ceramic cement. In a single pass core, such a reliable seal is not usually necessary, since no harm results from the leak of a gas from one channel over the top of a rib where the seal has failed to the adjoining parallel channel. However, in a triple pass core, if such a leak occurs at a divider rib, that is to say, a rib which separates opposite flows, the efficiency can be substantially reduced. This invention solves the problem by providing greater seal area, for example, by making the divider ribs, which separate opposite flows, thicker. Such thicker ribs provide greater area for sealing the rib to the layer thereabove.

Figure 4:
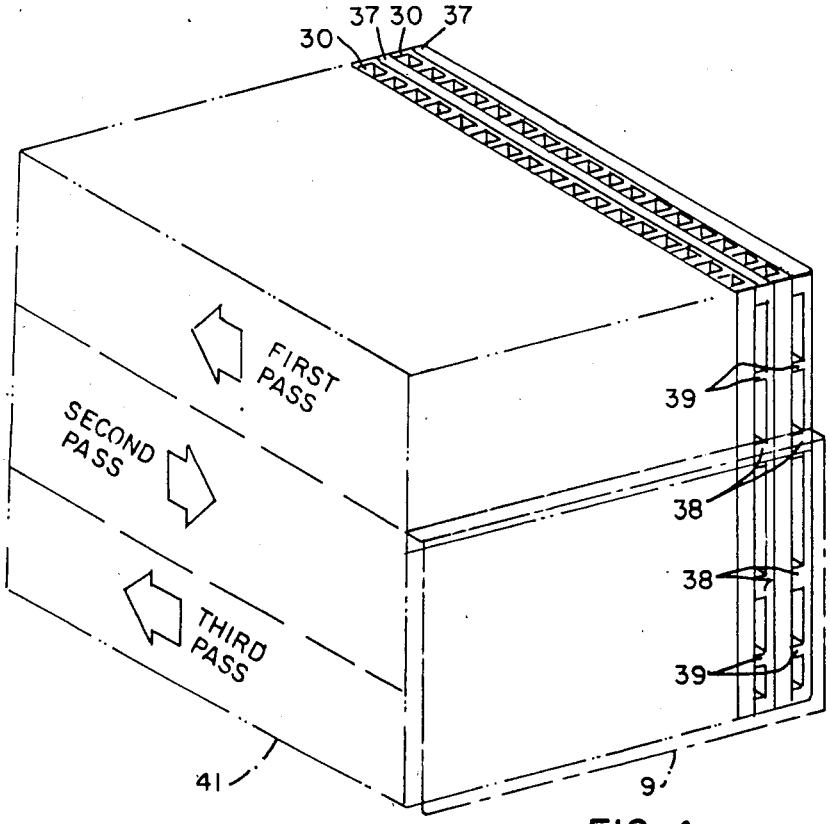

FIG. 4 a triple pass core, as per this invention.

Figure 5:
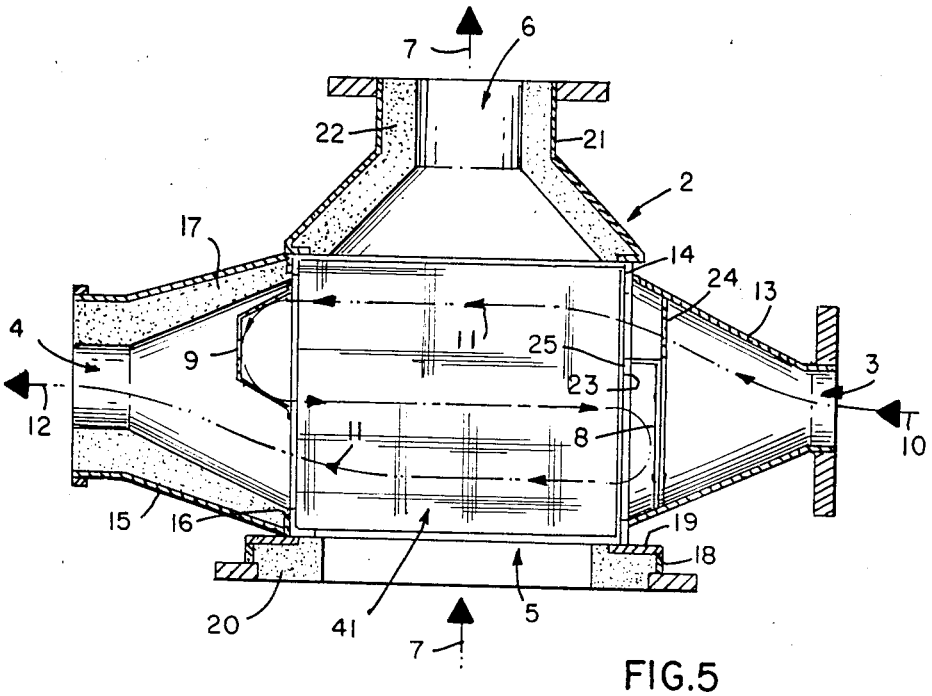

FIG. 5 shows a recuperator using a triple pass core in accordance with this invention.

Figure 6:
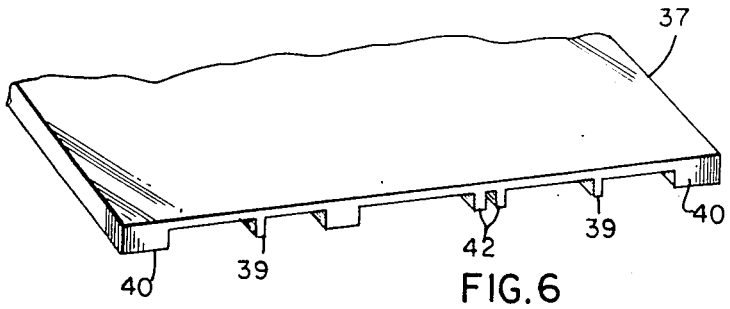

FIG. 6 shows another ribbed layer in accordance with this invention.

Figure 1:
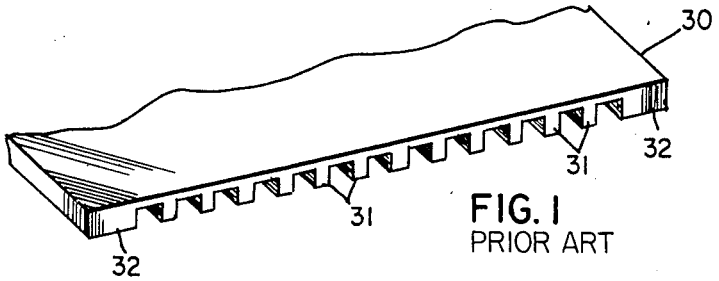
FIG. 1 PRIOR ART
FIG. 1 shows a prior art ribbed layer.
Figure 2:
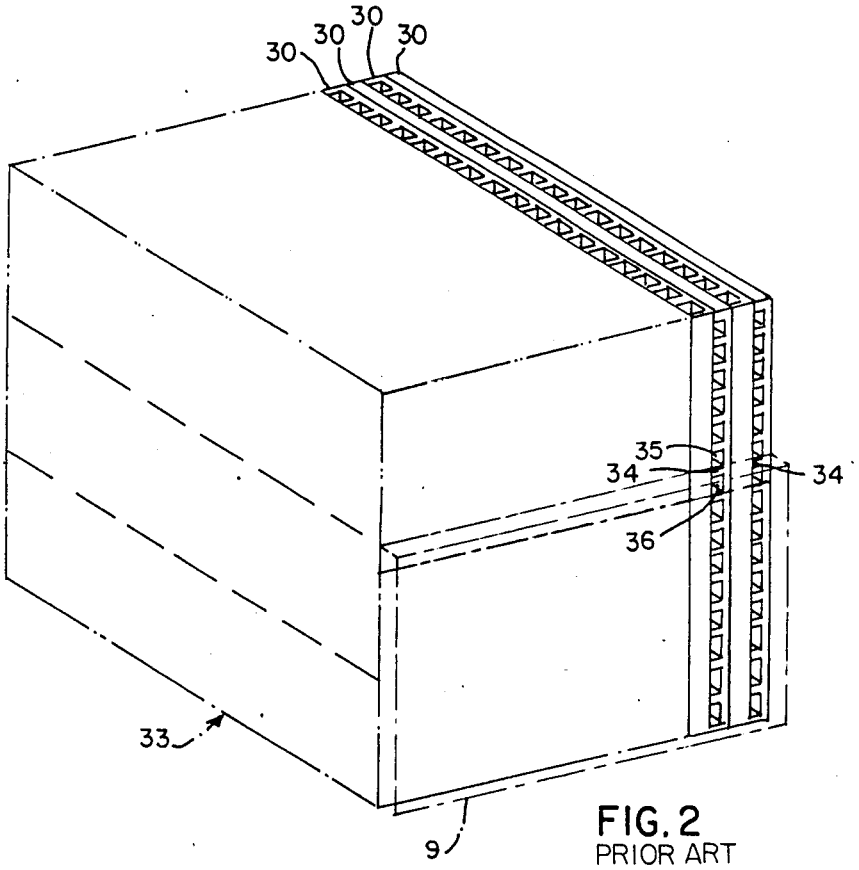
FIG. 2 PRIOR ART
FIG. 2 shows a prior art triple pass core.

In the prior art, a ceramic layer 30 for a cross-flow ceramic core had uniformly spaced narrow ribs 31 between its ends 32, as shown in FIG. 1. In a typical case, for a ten inch square layer 30, there were eleven such ribs 31, each 50 mils thick. A plurality of such layers 30 were stacked and bonded, as shown in FIG. 2, to form cross-flow ceramic core 33. When core 33 was used in a triple pass arrangement by the use of suitable inserts such as, for example, inserts 8 and 9 shown in FIG. 5, the ribs against which the inserts were faced acted as dividers for gas flow. For example, in FIG. 2, insert 9 is faced against divider ribs 34 an identically positioned in each layer. The gas flow in the channels above divider ribs 34 is in the opposite direction to the gas flow in the channels below ribs 34. Thus if, during the life of the core, one of ribs 34 becomes unbonded or separated from abutting layer 30 to which it had been sealed, the gas can leak over the top of the rib to the adjacent channel, in which gas flow is in the opposite direction. In FIG. 2, the leak would be from channel 35 over the separated top of rib 34 to channel 36. Such a leak is detrimental to the heat exchange efficiency of the core.

Figure 3:
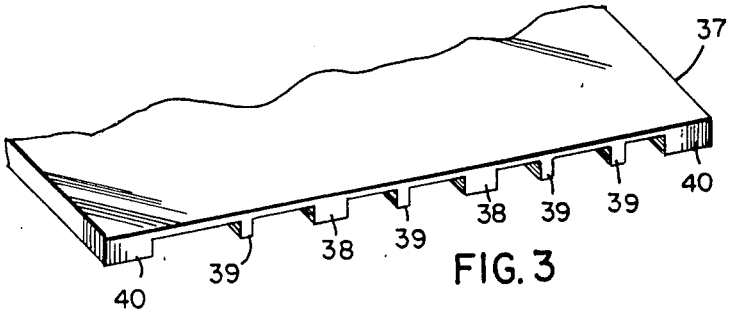
FIG. 3 shows a ribbed layer.

In a triple pass core in accordance with this invention, the divider ribs are arranged to provide greater seal area than in the prior art. For example, as shown in FIG. 3, ribbed layer 37 has two divider ribs 38, which are thicker than prior art ribs 31. These thicker ribs 38 permit a reduction in the total number of ribs so that, for a ten inch square layer 37, only four 50 mil thick supporting ribs 39 are needed between edges 40 along with two divider ribs 38, which were 200 mils thick. Thus, the eleven ribs 31 in FIG. 1 were replaced by six ribs in FIG. 3, four thick divider ribs 38 and two ribs 39 of the usual thickness.

FIG. 4 shows a core 41 made up of stacked and bonded layers 37 alternated with layers 30. Layers 37 were used only for the combustion air, since only the combustion air was thrice passed through core 41. Since the hot exhaust gases were only passed once through core 41 uniformly ribbed layers 30 could be used for the hot exhaust gases. For convenience, layers 37 could also have been used for the hot exhaust gases instead of layers 30. However, when so used, thick ribs 38 would not be performing as divider ribs, since the hot exhaust gas flow on each side of rib 38 would be in the same direction. In FIG. 4, insert 9 is faced with the upper set of thick ribs 38 of layers 37 through which the combustion air flows.

In one embodiment of a recuperator in accordance with this invention, as shown in FIG. 5, ceramic core 41 is contained within a housing 2. The combustion air enters at inlet 3 and exits at outlet 4. The hot exhaust gases enter at inlet 5, pass through layers 30 of core 41 in a single pass, and exit at outlet 6. Their path is shown by arrows 7.

The combustion air passes through core 41 in a triple pass. With first insert 8 and second insert 9 in place, the combustion air follows the path of arrow 10 at the inlet, arrows 11 within the core, and arrow 12 at the outlet, flowing through layers 37 within core 41.

In a specific example, housing 2 was made up of flanged metal conduits. Tapered conduit 13 which served as the inlet for incoming combustion air, was attached to rectangular metal flange 14 which was held in firm contact with the respective face of core 41 (with a suitable gasket therebetween), as shown in U.S. Pat. No. 4,300,627. Tapered conduit 15, which served as the outlet for the heated combusiton air, was similarly attached to rectangular metal flange 16 which was similarly attached to rectangular metal flange 16 which was similarly held in gasket contact with the respective face of core 41. Because conduit 15 can be exposed to high temperatures from the heated combustion air, it can be lined with a ceramic insulating layer 17.

Inlet conduit 18 for the hot exhaust gases was similarly attached to rectangular metal flange 19 which was similarly held in gasket contact with the respective face of core 41. Conduit 18 was also lined with a ceramic insulating layer 20. Exhaust conduit 21 for the hot exhaust gases was similarly attached and similarly lined with ceramic insulating layer 22.

First insert 8 for a ceramic core that was a one foot cube, was made for a 60 mil thick stainless steel sheet. The sheet was bent 90° on a line $\frac{5}{8}$" back from one end and then bent 90° again on a line about 1 $\frac{3}{4}$" back from said end. This provided an L shape with a narrow $\frac{5}{8}$" wide leg 23 that was parallely spaced about 1 $\frac{1}{8}$" from the main area of insert 8. Insert 8 was fastened to a perforated metal plate 24 that was fastened within conduit 13. The purpose of perforated metal plate was to aid in diffusing incoming combustion air. Insert 8 was so positioned within conduit 13 that leg 23 was in firm contact with the respective face of ceramic core 41, that is to say, actually in firm contact with gasket 25 therebetween, and the flow of incoming combustion air was diverted to the upper portion of ceramic core 41.

Second insert 9 was also made of stainless steel and was cap shaped. The edges thereof were in firm gasket contact with the respective face of ceramic core 41. Three of the four edges of outlet insert 9 were sandwiched between metal flange 16 and the respective face of ceramic core 1, which held insert 9 in place. As the combustion air flowed out of the left face of the upper portion of ceramic core 41, insert 9 directed the flow back through the middle third of ceramic core 41, as shown by arrows 11. Then, as the air exited at the right from said middle portion, insert 8 directed the flow back through the bottom portion of ceramic core 41, as shown by the arrows. The heated combustion air flowed out of recuperator outlet 4.

In the embodiment shown in FIG. 3, the first pass channel was the widest channel and, therefore, two supporting ribs 39 were used therein. Only one supporting rib 39 was used in each of the other two passes.

For purposes of this invention it is not necessary that a divider rib comprise a single thick rib, such as rib 38. Rib 38 may be replaced by two or more spaced apart ribs, such as ribs 42 shownin FIG. 6. At the time of stacking and bonding the layers, ceramic cement may be used to fill the space between the pair of ribs 42, if desired, as well as on the edges of the ribs for bonding to the layer above. The gap between ribs 42 should be less than the width of the facing leg or edge of inserts 8 and 9, so that said leg or edge is faced against the pair of ribs 42. In the previous example, the width of leg 23 was $\frac{5}{8}$", so the width of the dividing rib, which in FIG. 6 comprises the thickness of both ribs 42 plus the space between, would be about $\frac{5}{8}$" or less for said example. Preferably, ribs 42 are thicker than ribs 39.

As mentioned, divider ribs in accordance with this invention permit reduction in the total number of supporting ribs, so that the ribs between edges need not be uniformly spaced. This is desirable since reducing the number of ribs reduces resistance to air flow.

We claim:

1. A heat recuperator comprising a cross flow ceramic core within a housing, the core comprising ribbed layers for the flow therethrough of combustion air to be heated, the core also comprising other ribbed layers for the flow therethrough of hot exhaust gas, the combustion air ribbed layers being stacked alternatively with the hot gas ribbed layers, the air flow through the combustion air ribbed layers being orthogonal to the gas flow through the hot gas ribbed layers, the air flow through the combustion air ribbed layers being triple pass, the passes being separated from each other by divider ribs, each pass having supporting ribs therein providing channels for the air flow, the construction of the divider ribs being such as to reduce the number of said supporting ribs required for support of all the layers in the core, the divider ribs being thicker than the ribs in the hot gas ribbed layers, the divider ribs being sealed to prevent air in one pass from leaking to an adjoining pass, and metal inserts in the housing that face with the divider ribs so as to cause the air flow to be triple pass.

2. The heat recuperator of claim 1 wherein the divider ribs are thicker than the supporting ribs.

3. The heat recuperator of claim 1 wherein there are two divider ribs on each combustion air ribbed layer.

4. The heat recuperator of claim 1 wherein the part of each metal insert facing the divider ribs is a leg having about the same width as the divider ribs.

5. The heat recuperator of claim 1 wherein the first pass of the triple pass is wider than the other two passes and has two supporting ribs therein, there being only one supporting rib in each of the other two passes.

* * * * *